US006694579B2

(12) United States Patent
Belanger et al.

(10) Patent No.: US 6,694,579 B2
(45) Date of Patent: Feb. 24, 2004

(54) DISASTER RELIEF COFFIN BOX

(75) Inventors: Leon J. Belanger, Windham, ME (US); Mark Flinkstrom, Stow, ME (US)

(73) Assignee: International Paper Company, Tuxedo, NY (US)

( * ) Notice: Subject to any disclaimer, the term of this patent is extended or adjusted under 35 U.S.C. 154(b) by 0 days.

(21) Appl. No.: 10/094,602

(22) Filed: Mar. 7, 2002

(65) Prior Publication Data

US 2003/0167611 A1 Sep. 11, 2003

(51) Int. Cl.[7] ..... A61G 17/00
(52) U.S. Cl. ..... 27/4; 229/186
(58) Field of Search ..... 27/4; 220/4.28, 220/6; 229/125.01, 186

(56) References Cited

U.S. PATENT DOCUMENTS 3,574,906 A * 4/1971 Rittenhouse ..... 27/4
4,151,630 A * 5/1979 Havey ..... 27/2
4,156,956 A * 6/1979 Partridge et al. ..... 27/4
4,170,054 A * 10/1979 Ruffner et al. ..... 27/4
5,307,545 A * 5/1994 Stoltz ..... 27/4
5,586,679 A * 12/1996 Thomas ..... 27/4
5,661,879 A * 9/1997 Kelly ..... 27/2
5,862,847 A * 1/1999 Jenkins ..... 144/346
6,145,175 A * 11/2000 Enneking et al. ..... 27/4
6,202,270 B1 * 3/2001 Bowman et al. ..... 27/4
6,317,943 B1 * 11/2001 Wood ..... 27/4
6,317,944 B1 * 11/2001 Beaulieu et al. ..... 27/4

* cited by examiner

*Primary Examiner*—William L. Miller
(74) *Attorney, Agent, or Firm*—Dennis H. Lambert

(57) ABSTRACT

A disaster relief coffin box made of moisture resistant corrugated cardboard that may be shipped and stored in a flattened condition and erected at the point of use to form a container having a bottom portion and a top or cover. The bottom portion and cover are each made of a single blank of material, and include interlocking panels that retain them in their erected and sealed condition without requiring the use of tape, glue, stitching or other fasteners. Gusset corner panels ensure a leak-proof structure.

5 Claims, 4 Drawing Sheets

DISASTER RELIEF COFFIN BOX

BACKGROUND OF THE INVENTION

1. Field of the Invention

This invention relates to containers for holding the bodies of deceased persons. More specifically, the invention relates to an inexpensive container for holding the body of a person killed as a result of a disaster, when many bodies need to be handled in a very short time.

2. Prior Art

It sometimes happens that a large number of persons are killed as a result of a single event, or a series of closely related events. For example, floods, earthquakes and other natural disasters frequently result in great loss of life. Similarly, accidents, war, civil disturbance, terrorist actions, and other events sometimes result in the deaths of large numbers of people. To prevent the spread of disease, and for humanitarian reasons, it is important that the bodies of those persons killed be collected and processed as soon as possible for burial or other appropriate disposal. Moreover, it may sometimes be necessary to collect bodies at a remote location and ship them to another site for burial or other appropriate handling.

Particularly when these disasters occur in less developed areas of the world, or at remote locations, the efficient and humane handling of bodies can present a problem. For example, these areas may be relatively inaccessible, and convenient means for storing and handling the bodies are usually not available. In many instances, body bags are used, or in some cases the bodies may even be wrapped in shrouds or blankets for handling. In extreme cases, the bodies may not be placed in any type of container, even a simple wrap. In these instances, it is difficult to store and handle the bodies, especially for transportation to another site.

Accordingly, there is need for an inexpensive and efficient means for containing the bodies of disaster victims to facilitate the handling, storage and transportation of the bodies.

SUMMARY OF THE INVENTION

A simple and inexpensive container is provided in accordance with the invention for holding the bodies of deceased persons to facilitate the handling and storage of the bodies.

The container of the invention is preferably made of corrugated cardboard, and is preferably suitably treated for moisture resistance. The container may be shipped in a knocked-down or flattened condition and erected at the point of use, thereby reducing the cost of storage and shipment of the container and facilitating its use and availability, particularly at remote and relatively inaccessible locations.

The container may be used simply to facilitate the handling and transportation of bodies, and/or it may be used for burial or cremation.

In its preferred embodiment, the container comprises a bottom and a cover or lid, each formed from a single blank of material suitably cut and scored to facilitate erection, and to achieve self-locking in the erected condition.

The blank from which the bottom is erected comprises a central bottom panel with first, second and third side panels foldably joined to each of the opposite sides thereof, an end panel foldably joined to each of the opposite ends of the bottom panel, and corner panels having a diagonal fold line extending from the juncture of the folds connecting the respective adjacent end and first side panels with the bottom panel, to the opposite outside corner of the corner panel. Inwardly foldable locking flaps and tabs are on the opposite ends of the second, or intermediate, side panels for locking engagement behind locking tabs on the outer edges of the opposite end panels when the box is erected.

In an alternate embodiment, the bottom comprises a bottom panel with single side panels foldably joined to opposite side edges thereof, and gusset folds in the corners connect the ends of the side panels with the end panels. The gusset folds have a stepped configuration on their outer corners, defining a point or shoulder when the gusset folds are folded inwardly against the end panels. Locking flaps on the end panels are foldable inwardly over the point or shoulder on the gusset folds to hold the container in erected condition.

The blank from which the top is erected comprises a central panel with opposite end panels foldably joined to opposite ends thereof, and first and second side panels foldably joined to each of the opposite sides of the central panel. A locking flap is foldably joined to each of the opposite sides of each of the end panels, and these locking flaps are engaged between the first and second side panels at opposite sides of the top when the top is in its erected condition. Locking tabs are also formed along the free edges of each of the second side panels for locking engagement in slots formed at the juncture of the central and side panels.

The container of the invention is inexpensive and lightweight in construction, may be stored and shipped in a flattened or knocked-down condition, and is easy to use. It facilitates the humane and convenient handling of bodies, whether for storage, shipment, burial or cremation.

BRIEF DESCRIPTION OF THE DRAWINGS

The foregoing, as well as other objects and advantages of the invention, will become apparent from the following detailed description when considered in conjunction with the accompanying drawings, wherein like reference characters designate like parts throughout the several views, and wherein.

DETAILED DESCRIPTION OF THE PREFERRED EMBODIMENTS

Figure 1:
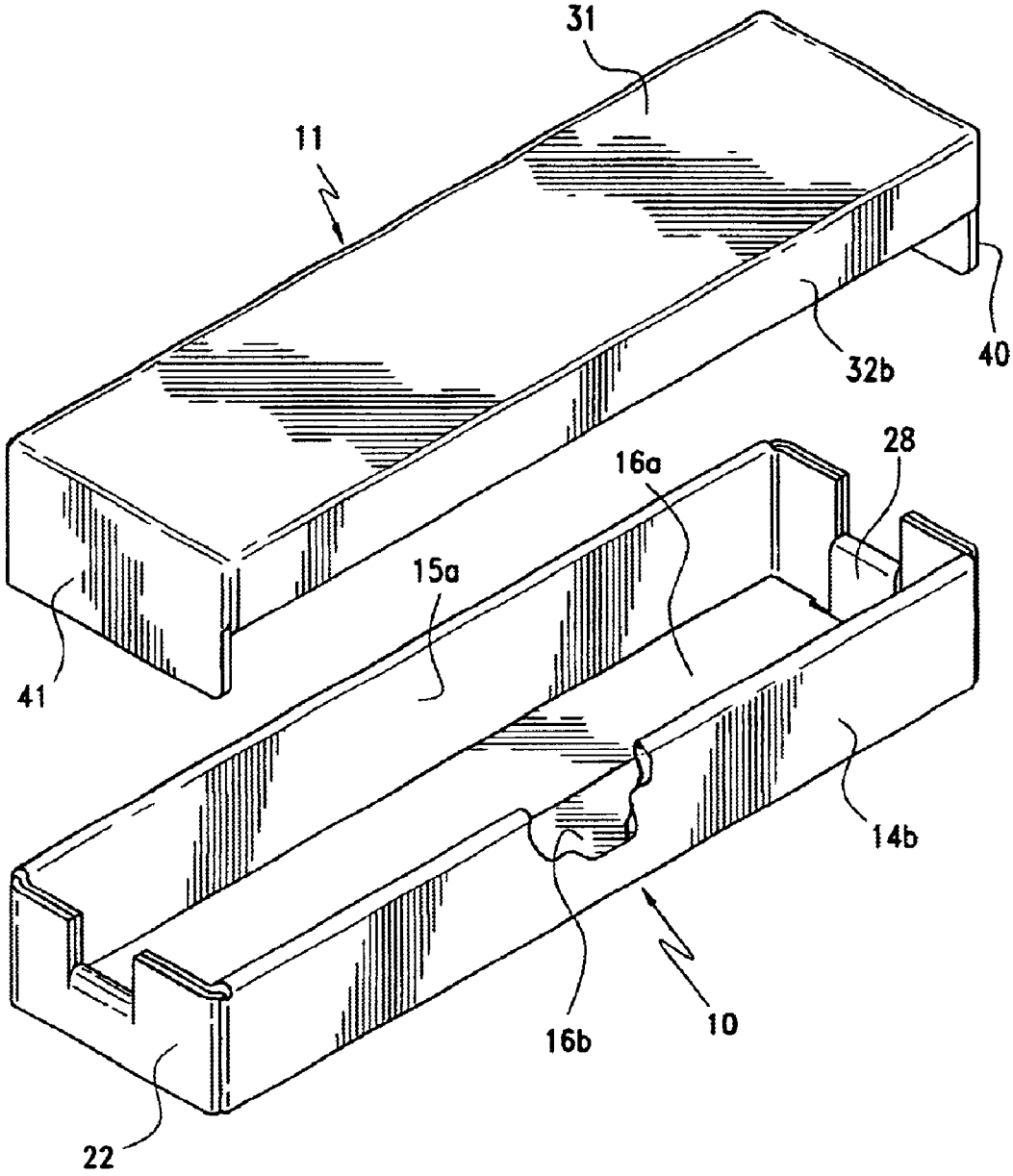
FIG. 1 is an exploded top perspective view of the container of the invention, with the bottom and top shown in their erected condition.

With reference first to FIG. 1, the container of the invention comprises a generally rectangular bottom portion 10 and a top or cover 11.

Figure 2:
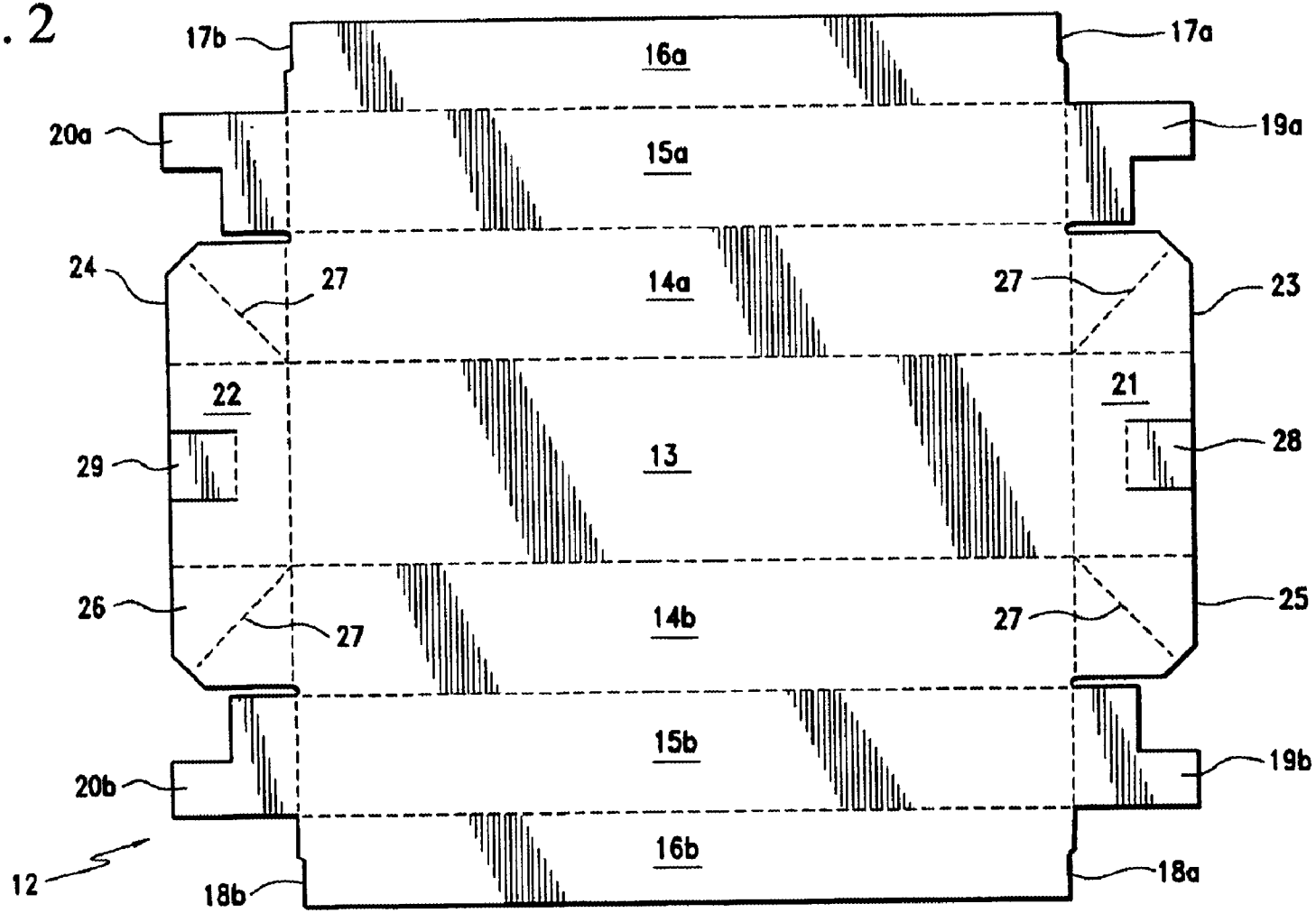
FIG. 2 is a top plan view of the blank from which the bottom portion is erected.
Figure 3:
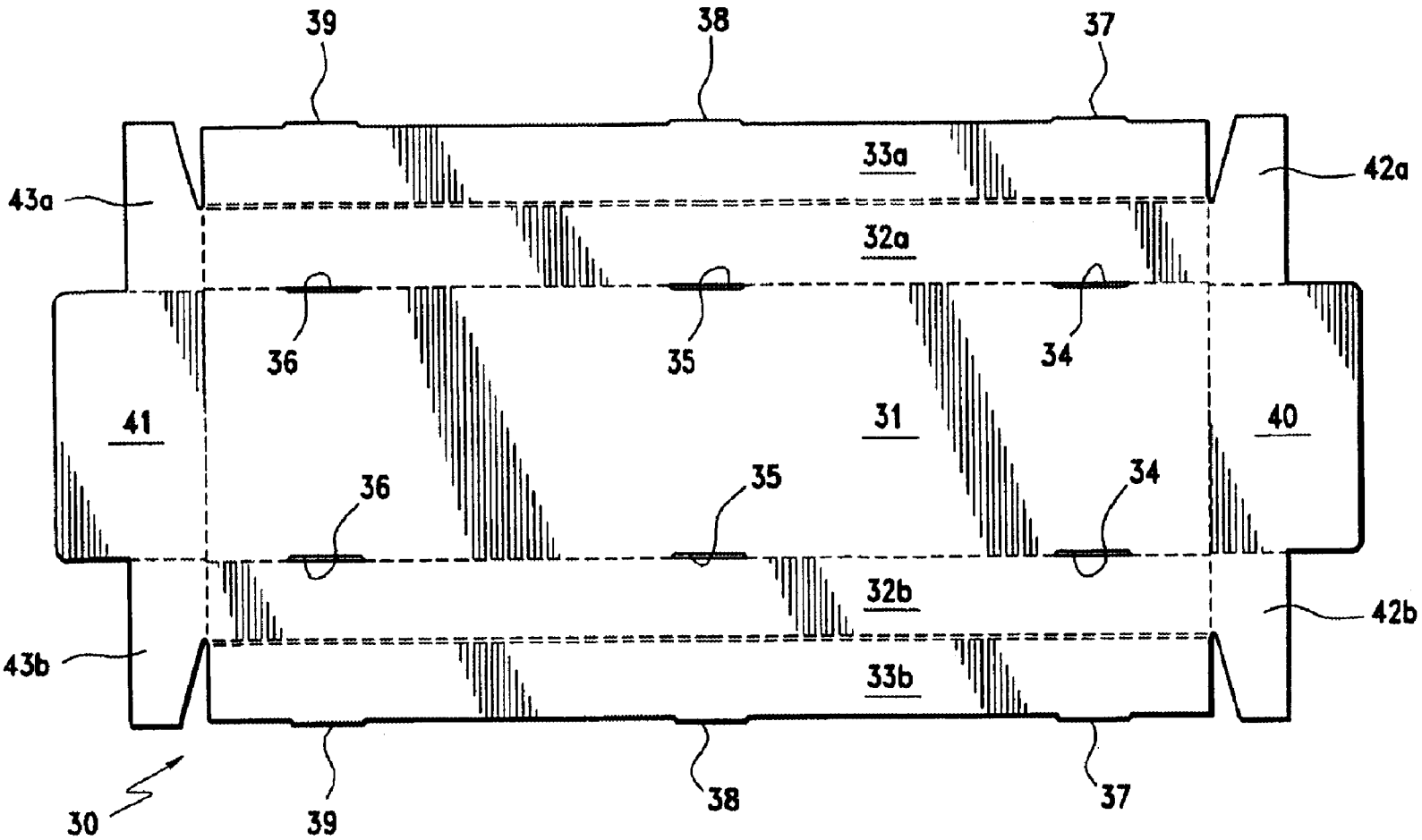
FIG. 3 is a top plan view of the blank from which the top is erected.

The blank 12 from which the bottom portion 10 is erected is shown best in FIG. 2 and comprises a central rectangular bottom panel 13, with first side panels 14*a* and 14*b* foldably joined along one edge to respective opposite sides of the bottom panel. Second side panels 15*a* and 15*b* are foldably joined along one edge to the opposite edges of the respective first side panels, and third side panels 16*a* and 16*b* are foldably joined to the opposite edges of the respective second, or intermediate, side panels. Shallow cutouts or notches 17*a*, 17*b* and 18*a*, 18*b* are formed in the opposite ends of respective third side panels, and generally L-shaped locking flaps 19*a*, 20*a* and 19*b*, 20*b* are foldably joined to opposite ends of respective second side panels. Opposite end panels 21 and 22 are foldably joined to opposite ends of the bottom panel, and gusset corner panels 23, 24 and 25, 26 are foldably joined to respective adjacent side edges of the end panels and first side panels. A diagonal gusset fold line 27 extends across each of the gusset corner panels, from the corners of the bottom panel to opposite outer corners of the gusset corner panels.

To erect the bottom 10, the gusset folds 27 are creased inwardly and the first side panels 14*a* and 14*b* and the end panels 21 and 22 are folded upwardly. Second side panels 15*a* and 15*b* are then folded inwardly and downwardly alongside the first side panels, with the diagonally folded corner panels 23–26 engaged between the respective first and second side panels. The third side panels 16*a* and 16*b* are then folded inwardly over the bottom panel 13, with the L-shaped locking flaps 19*a*, 19*b* and 20*a*, 20*b* lying alongside the inner surface of the end panels 21 and 22. Locking tabs 28 and 29 are then folded inwardly over the narrow portions of the L-shaped locking flaps and engaged in the notches 17*a*, 17*b* and 18*a*, 18*b* to lock the bottom portion of the container in its erected condition.

The blank 30 from which the top or cover 11 is erected comprises a rectangular central panel 31 having first and second side panels 32*a*, 32*b* and 33*a*, 33*b* foldably joined to respective opposite sides thereof. A plurality of notches 34, 35 and 36 are formed along opposite side edges of the central panel, and complementary locking tabs 37, 38 and 39 are formed on the outer edges of the second side panels. Opposite end panels 40 and 41 are foldably joined to opposite ends of the central panel, and locking flaps 42*a*, 43*a* and 42*b*, 43*b* are foldably joined to opposite side edges of the end panels.

To erect the top or cover 11, the locking flaps 42*a*, 43*a* and 42*b*, 43*b* are folded inwardly and the end panels 40 and 41 are folded upwardly. The first side panels 32*a* and 32*b* are then folded upwardly, and the second side panels 33*a* and 33*b* are folded downwardly alongside the inner surface of the first side panels, with the locking flaps engaged between the first and second side panels. The locking tabs 37, 38 and 39 on the second side panels are engaged in the notches 34,35 and 36 to hold the top in its erected condition.

Figure 4:
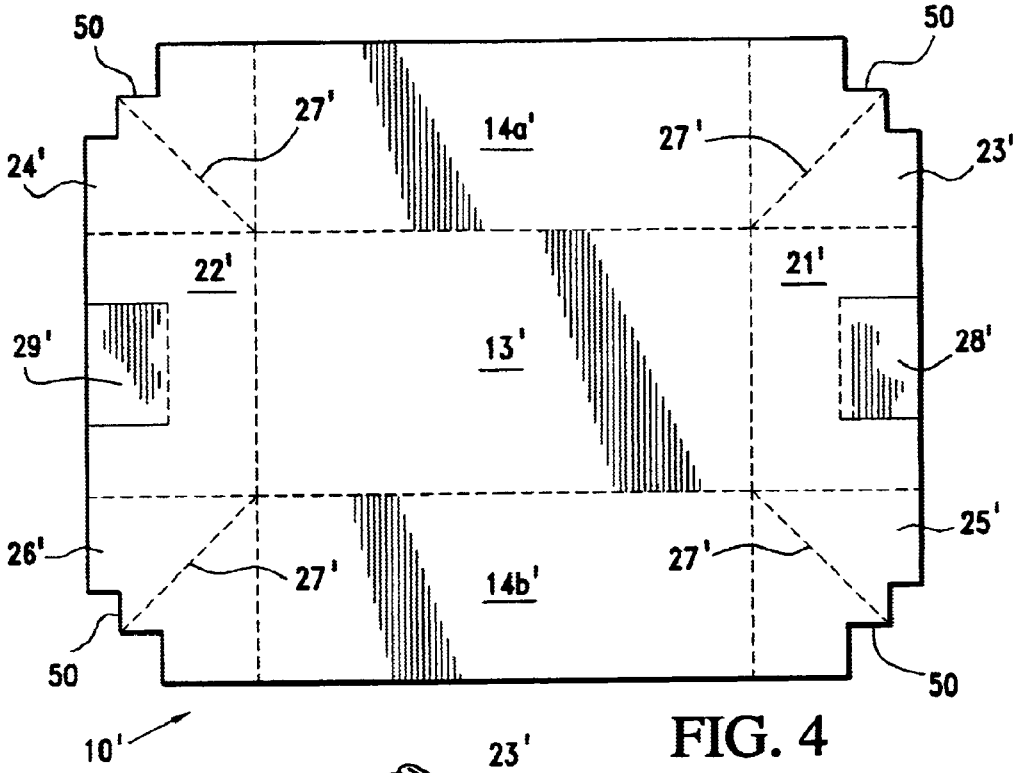
FIG. 4 is a top plan view of the blank for forming an alternate embodiment of the bottom portion of the container.
Figure 5:
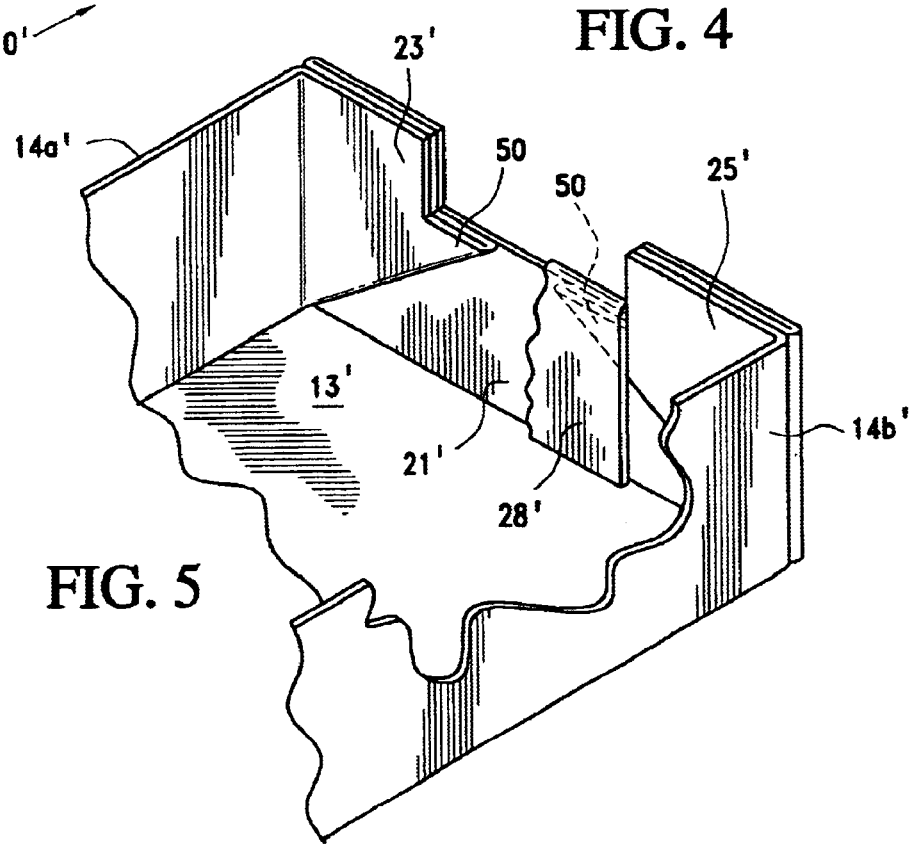
FIG. 5 is a fragmentary, inner top perspective view of one end of a partially folded container, showing a locking flap being folded over the points on the gusset corner folds.

A blank for forming a simpler version of the bottom is indicated generally at 10' in FIG. 4. In this embodiment, the gusset corner panels 23', 24', 25' and 26' are differently shaped, having a recessed outer corner with a stepped configuration that defines a point 50 when the gusset corner is folded inwardly against the adjacent end wall panel 21' or 22', and only single side panels 14*a*' and 14*b*' are foldably joined to opposite side edges of the bottom panel 13'.

To erect the version shown in FIG. 4, the diagonal folds 27' in the corner panels are creased inwardly, and the side and end panels are folded upwardly so that the diagonally folded gusset corner panels lie against the inner surface of the end panels 21' and 22'. The locking flaps or tabs 28' and 29' on the end panels are then folded downwardly over the shoulders or points 50 on the inwardly folded gusset corner panels to hold the container in its erected condition.

Although the container of the invention may be made of any suitable material, in one construction the bottom 10 or 10' is constructed of 275# C-Kraft with a 40# medium. The top 11 may be constructed of the same material, or a 44-ECT may be used. The bottom and top may be treated with Vinnings X-3100 coating on one liner, and an internal poly coating within the other liner.

The resulting container is leak-resistant, and when erected requires no additional taping, gluing or stitching to seal it closed.

While particular embodiments of the invention have been illustrated and described in detail herein, it should be understood that various changes and modifications may be made to the invention without departing from the spirit and intent of the invention as defined by the scope of the appended claims.

What is claimed is:

1. A disaster relief coffin box that may be shipped and stored in a flattened or knocked-down condition and erected at the point of use, comprising:

a container bottom portion having a bottom wall, opposite end walls and opposite side walls, and a container top or cover for placement on the bottom portion;

said container bottom portion being constructed from a single blank of corrugated cardboard cut and scored so that it may be shipped flat and erected at the point of use, said blank having:

(a) a central panel with opposite side edges and opposite ends and forming a part of the bottom wall;

(b) a first side panel foldably joined along one edge to each of the opposite side edges of the central panel;

(c) a second side panel foldably joined along one edge to an opposite edge of each of the first side panels;

(d) a third side panel foldably joined along one edge to an opposite edge of each of the second side panels;

(e) an end panel foldably joined to each of the opposite ends of the central panel;

(e) a gusset corner panel foldably joined along adjacent orthogonal edges thereof to respective adjacent edges of the end panels and the first side panels, respectively, said gusset corner panels each having a diagonal gusset fold line extending from respective adjacent corners of the central panel to a diagonally opposite corner of the gusset corner panel;

(g) a locking flap foldably joined to opposite ends of each of the second side panels; and (h) a locking tab foldably joined to an edge of each end panel opposite its foldable connection with the central panel;

said container bottom portion, in its erected condition, having the gusset corner panels folded inwardly along the diagonal fold lines, with the end panels and the first side panels folded upwardly and the second side panels folded downwardly alongside an inner surface of the first side panels to form the side walls, with the folded gusset corner panels engaged between the first and second side panels, and the locking flaps lying alongside an inner surface of the end panels, the third side panels folded inwardly over the central panel and forming therewith the bottom wall, and the locking tabs on the opposite end walls folded inwardly over the locking flaps to retain the bottom portion in its erected condition.

2. A blank for making a bottom portion of a disaster relief coffin box having the bottom portion and a cover, comprising:

a central panel having opposite side edges and opposite end edges;

a first side panel foldably connected along a first edge thereof to each of the side edges of the central panel;

a second side panel foldably connected along a first edge to a second edge of the first side panel, and having opposite ends;

a third side panel foldably connected along a first edge to a second edge of the second side panel;

a locking flap on each of the opposite ends of the second side panel;

an end panel foldably connected along a first edge thereof to each of the end edges of the central panel;

a gusset corner panel connected between adjacent end edges of respective side and end panels; and a locking tab on a second edge of each of the end panels, said locking tabs being foldable over at least a portion of adjacent gusset corner panels to hold the bottom portion in erected condition when it is fully assembled.

3. A disaster relief coffin box made of corrugated cardboard that may be shipped and stored in a flattened condition and erected at the point of use to form a container having a bottom portion and a top or cover, said bottom portion and cover each made of a single blank of material, and including interlocking panels that retain them in their erected and sealed condition without requiring the use of tape, glue, stitching or other fasteners, said bottom portion comprising a bottom panel, opposite side wall panels, opposite end wall panels, corner gusset panels connected between adjacent side and end wall panels, and locking tabs on upper edges of the end walls folded inwardly and downwardly over adjacent corner gusset panels to hold the box in erected condition, wherein:

said opposite side wall panels each comprise first, second and third side wall panels foldably connected together, said first side wall panel being joined to the bottom panel, the second side wall panel being joined to the first side wall panel, and the third side wall panel being joined to the second side wall panel;

a locking flap is foldably connected to opposite ends of each of said second side wall panels; and a locking notch is formed in opposite ends of each said third side wall panel, wherein said first side wall panel is folded into perpendicular relationship with the bottom panel and the second side wall panel is folded inwardly into overlying parallel relationship with the first side wall panel, the third side wall panel is folded inwardly into overlying relationship with the bottom panel, the locking flaps are folded inwardly against the respective end wall panels, and the locking tabs are folded inwardly over the locking flaps and engaged in the locking notches to hold the box in erected condition.

4. A disaster relief coffin box made of corrugated cardboard that may be shipped and stored in a flattened condition and erected at the point of use to form a container having a bottom portion and a top or cover, said bottom portion and cover each made of a single blank of material, and including interlocking panels that retain them in their erected and sealed condition without requiring the use of tape, glue, stitching or other fasteners, said bottom portion comprising a bottom panel, opposite side walls, opposite end walls, corner gusset panels connected between adjacent side and end walls, and locking tabs on upper edges of the end walls folded inwardly and downwardly over adjacent corner gusset panels to hold the box in erected condition, wherein:

said opposite side walls each comprise a plurality of side wall panels foldably connected together, two of said side wall panels folded to lie alongside one another to form a double thickness side wall, and another of said side wall panels folded to overlie the bottom panel and form a double thickness bottom.

5. A blank for making a disaster relief coffin box having a bottom wall, opposite end walls and opposite side walls, and that may be shipped and stored in a flattened or knocked-down condition and erected at the point of use, comprising:

a central panel with opposite side edges and opposite ends and that forms the bottom wall in the erected box;

a first side panel foldably joined along one edge to each of the opposite side edges of the central panel, and a second side panel foldably joined along one edge to an opposite edge of the first side panel, said first and second side panels being foldable to form said side walls;

an end panel foldably joined to each of the opposite ends of the central panel, said end panels being foldable to form said end walls;

a locking flap foldably joined to opposite ends of each of the second side panels; and a locking tab foldably joined to an edge of each end panel opposite its foldable connection with the central panel;

the end panels and the first side panels being foldable upwardly in the erected condition of said bottom portion, and the second side panels being foldable downwardly alongside an inner surface of the first side panels to form the side walls, with the locking flaps lying alongside an inner surface of the end panels, and the locking tabs on the opposite end walls foldable inwardly over the locking flaps to retain the bottom portion in its erected condition.

* * * * *